US009885544B2

(12) United States Patent
Baron, Sr.

(10) Patent No.: US 9,885,544 B2
(45) Date of Patent: Feb. 6, 2018

(54) APPLIQUE ARMOR AND MOUNTING SYSTEM

(71) Applicant: Robert R. Baron, Sr., Millville, NJ (US)

(72) Inventor: Robert R. Baron, Sr., Millville, NJ (US)

( * ) Notice: Subject to any disclaimer, the term of this patent is extended or adjusted under 35 U.S.C. 154(b) by 232 days.

(21) Appl. No.: 14/798,579

(22) Filed: Jul. 14, 2015

(65) Prior Publication Data

US 2016/0010953 A1 Jan. 14, 2016

Related U.S. Application Data

(60) Provisional application No. 62/024,142, filed on Jul. 14, 2014.

(51) Int. Cl.
*F41H 5/013* (2006.01)

(52) U.S. Cl.
CPC ..... *F41H 5/013* (2013.01)

(58) Field of Classification Search
CPC ... F41H 5/013; E04H 9/04; E04H 9/14; F16B 5/002
USPC ..... 89/36.08, 36.11, 36.12, 36.17, 36.16, 89/36.13, 36.04, 36.01, 36.02; 114/9, 11, 114/12, 14; 52/582.1, 586.1; 403/73
See application file for complete search history.

(56) References Cited

U.S. PATENT DOCUMENTS

H000129 H * 9/1986 Hansen ..... 52/764
4,738,184 A * 4/1988 Bohne ..... F41H 5/013 89/36.02
4,928,468 A * 5/1990 Phillips ..... E04B 1/04 109/78
5,421,238 A * 6/1995 Catalano ..... F41H 5/013 109/49.5
5,499,568 A * 3/1996 Turner ..... F41H 5/013 109/79
5,792,974 A * 8/1998 Daqis ..... F41H 5/013 109/49.5
6,082,240 A * 7/2000 Middione ..... F41H 5/013 296/187.07
6,684,592 B2 * 2/2004 Martin ..... A63C 19/00 403/331
7,802,414 B1 * 9/2010 Nolte ..... E04H 9/10 52/578
7,913,611 B2 * 3/2011 Terry ..... F41H 5/0414 89/36.02
8,499,678 B2 * 8/2013 Adam ..... F41H 5/013 89/36.01
2004/0154464 A1 * 8/2004 Zurek ..... F41H 7/035 89/36.08
2005/0262999 A1 * 12/2005 Tomczyk ..... F41H 5/0457 89/36.02

(Continued)

FOREIGN PATENT DOCUMENTS

DE 3931895 A1 * 12/1994 ..... F41H 5/007

*Primary Examiner* — Reginald Tillman, Jr.
(74) *Attorney, Agent, or Firm* — Ballard Spahr LLP

(57) ABSTRACT

Applique armor has a mounting plate with a channel that receives flanged beam mounted on a structure to be protected. A box is attached to the mounting plate opposite the channel. The box contains an open cell layer. When applied to a structure, adjacent mounting plates interlock using mortise and tenon, and mounting plates arranged one behind another overlap with boxes on neighboring mounting plates to eliminate gaps in the armor.

5 Claims, 7 Drawing Sheets

(56) References Cited

U.S. PATENT DOCUMENTS

2017/0130452 A1* 5/2017 Phillips ..... E04B 1/92

* cited by examiner

APPLIQUE ARMOR AND MOUNTING SYSTEM

CROSS REFERENCE TO RELATED APPLICATION

This application is derived from and claims priority to U.S. Provisional Application No. 62/024,142, filed Jul. 14, 2014 and hereby incorporated by reference.

FIELD OF THE INVENTION

This invention relates to applique armor for military vehicles, and a system for rapidly mounting and removing applique armor from any vehicle.

BACKGROUND

Improvised explosive devices (IEDs) have proved to be a deadly threat to unarmoured military vehicles such as trucks and high mobility multipurpose vehicles (Humvees) which lack sufficient armor protection. IEDs have further evolved in lethality to menace wheeled armored vehicles such as the "Stryker", as well as tracked vehicles such as main battle tanks.

The effectiveness of IEDs is especially apparent in asymmetrical warfare scenarios such as found in Middle East conflicts, where there is no clear frontline and no completely secure rear areas where vehicles can operate with impunity. Casualty lists numbering in the thousands are sad testament to the effects of IEDs on unarmored and insufficiently armored vehicles as used in the field today.

While steps have been taken to "up-armor" vehicles, for example, by permanently attaching rolled homogeneous armor plate (RHA) to the sides and undersides of vehicles, there are drawbacks to such measures. The armor plate adds significant weight to the vehicle and requires extensive and time consuming structural modifications to permanently mount the armor on the chassis, hull, or other parts of the vehicle. There is clearly a need for effective applique armor that can be easily mounted to vehicles (and removed therefrom when not required) to improve their resistance to blast damage from IEDs and other ballistic threats and thereby afford greater safety and survivability to their crews in combat.

SUMMARY

Applique armor according to the invention, when compared with rolled homogeneous armor steel plate, is expected to provide advantages of lighter specific weight, increased energy absorption, easier mounting and transport and reduction in life cycle cost with virtually no maintenance cost and ease of storage and transport. In addition, when vehicles do not require the additional applique armor it can be transferred easily to any other type of vehicle for immediate use (provided that the mounting system, such as I-beams, are pre-welded to the vehicle), thus conserving significant amounts of funding. A maintenance free life cycle of more than 20 years is expected.

An example of applique armor according to the invention comprises a mounting plate having first and second surfaces oppositely disposed. A channel is positioned in the mounting plate and extends along the first surface. A box is attached to the second surface of the mounting plate. An open cell layer may be positioned within the box. In a particular example embodiment the channel has a T shaped cross section.

By way of further example the mounting plate comprises first and second edges oppositely disposed and extending substantially parallel to the channel. In this example a mortise is positioned in the mounting plate and extends along the first edge. A tenon extends along the second edge and projects outwardly therefrom. In an example embodiment he mortise and the tenon have a T shaped cross section. In another example the mortise and the tenon have a bulbous head cross section.

In an example embodiment the mounting plate has a first end and a second end oppositely disposed. In this example the box has a first end and a second end oppositely disposed, and the first end of the box is offset from the first end of the mounting plate. By way of further example the second end of the box is also offset from the second end of the mounting plate.

In another example embodiment the first end of the box projects outwardly from the first end of the mounting plate, and the second end of the mounting plate projects outwardly from the second end of the box. In a particular example embodiment the mounting plate, the box and the open cell layer are made of titanium.

In a specific example embodiment the box comprises first and second end panels oppositely disposed, and first and second side panels oppositely disposed. In this example the first and second end panels have a thickness less than a thickness of the first and second side panels. By way of example the applique armor may further comprises an open cell layer positioned within the box, wherein the open cell layer is oriented with open ends of cells facing the first and second end panels.

In another example embodiment the box comprises a panel positioned in spaced relation to the second surface of the mounting plate. The panel forms a bottom of the box and has a plurality of vent holes therethrough.

The invention also encompasses, in combination, applique armor and a mounting system for mounting the applique armor to a structure. In an example embodiment the combination comprises at least one mounting plate having first and second surfaces oppositely disposed. A channel is positioned in the at least one mounting plate and extends along the first surface. A box is attached to the second surface of the at least one mounting plate. A beam is received within the channel, the beam being attachable to the structure.

Another example may further comprise an open cell layer positioned within the box. In an example embodiment the channel has a T shaped cross section and the beam comprises a web and a flange attached to the web. The web and flange are sized to be received within the channel.

In another example embodiment of the combination, the at least one mounting plate further comprises first and second edges oppositely disposed and extending substantially parallel to the channel. In this example a mortise is positioned in the mounting plate and extends along the first edge. Further in this example a tenon extends along the second edge and projects outwardly therefrom. In a specific example embodiment the mortise and the tenon have a T shaped cross section. In another example embodiment, the mortise and the tenon have a bulbous head cross section.

In another example embodiment the at least one mounting plate has a first end and a second end oppositely disposed and the box has a first end and a second end oppositely disposed. In this example the first end of the box is offset from the first end of the mounting plate. In a further example embodiment the second end of the box is offset from the second end of the mounting plate. By way of further example, the first end of the box projects outwardly from the first end of the mounting plate, and the second end of the mounting plate projects outwardly from the second end of the box.

By way of example a slot is positioned proximate to one end of the beam and a wedge is removably positioned within the slot for retaining the at least one mounting plate on the beam.

An example combination of applique armor and a mounting system for mounting the applique armor to a structure further comprises a plurality of mounting plates. In this example each of the mounting plate comprises first and second surfaces oppositely disposed. A channel extends along the first surface. A box is attached to the second surface of each of the mounting plates. By way of example the combination further comprises a plurality of beams received within the channels. The beams are attachable to the structure, and the mounting plates are arranged on the beams one behind another and one adjacent another.

By way of further example an open cell layer is positioned within each the box. In an example embodiment each of the channels has a T shaped cross section and each of the beams comprises a web and a flange attached to the web, the webs and flanges being sized to be received within the channels.

In a further example embodiment, each of the mounting plates comprises first and second edges oppositely disposed and extending substantially parallel to the channel. A mortise is positioned in the mounting plate and extends along the first edge. A tenon extends along the second edge and projects outwardly therefrom. In this example, for the mounting plates positioned adjacent to one another, the tenon on one of the mounting plates engages a mortise on another of the mounting plates.

In another example each of the mounting plates has a first end and a second end oppositely disposed. Each of the boxes has a first end and a second end oppositely disposed. In this example the first ends of each of the boxes project outwardly from the first ends of each of the mounting plates, and the second ends of each of the mounting plates project outwardly from each of the second ends of each of the boxes. Additionally by way of example, for the mounting plates positioned one behind another, the second ends of the mounting plates overlap the first ends of the boxes.

Also by way of example, first and second slots are positioned proximate to opposite ends of each of the beams, and first and second wedges are removably positioned within the slots for retaining the mounting plates on the beam.

The invention further comprises a method of mounting applique armor on a structure. In one example embodiment the method comprises:

mounting at least one beam on the structure;

engaging a channel in a first mounting plate with the at least one beam;

sliding the first mounting plate lengthwise along the beam to a first position.

By way of example, the method further includes:

engaging a channel in a second mounting plate with the at least one beam;

sliding the second mounting plate along the at least one beam to a second position adjacent to the first mounting plate.

An example method also includes overlapping a portion of the first mounting plate with a portion of the second mounting plate upon sliding the second mounting plate into the second position.

An example method further comprises:

mounting at least a second beam on the structure in spaced relation adjacent to the at least one beam;

engaging a channel in a second mounting plate the second beam;

sliding the second mounting plate along the second beam to a second position adjacent to the one mounting plate.

This example method may further comprise engaging a mortise on the second mounting plate with a tenon on the first mounting plate upon sliding the second mounting plate into the second position, or engaging a tenon on the second mounting plate with a mortise on the first mounting plate upon sliding the second mounting plate into the second position.

DETAILED DESCRIPTION

Figure 1:
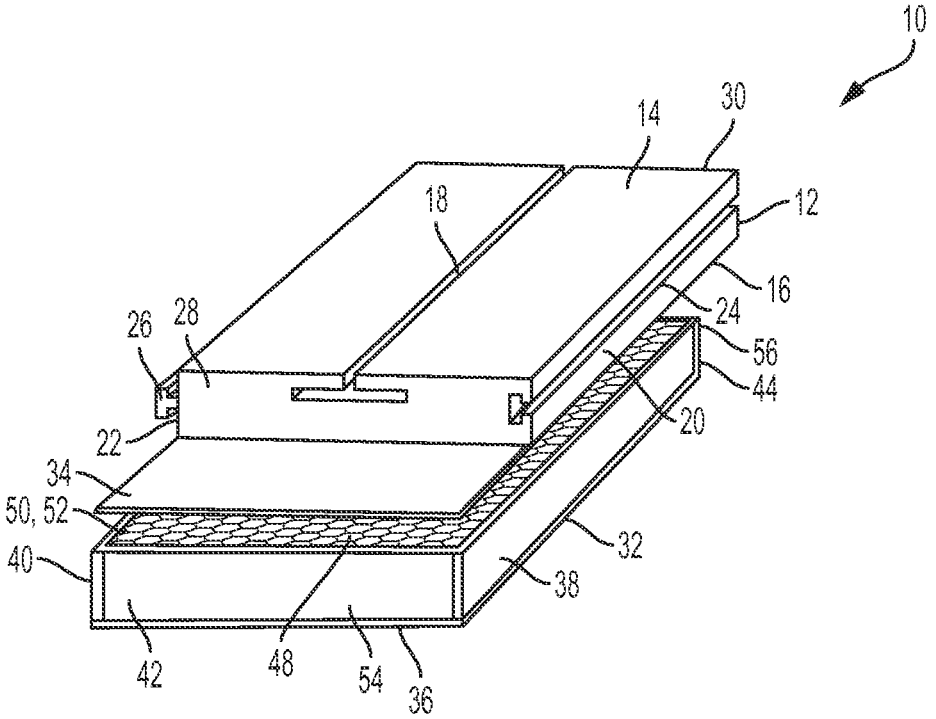
FIG. 1 is a partially exploded isometric view of an example embodiment of applique armor according to the invention.
Figure 2:
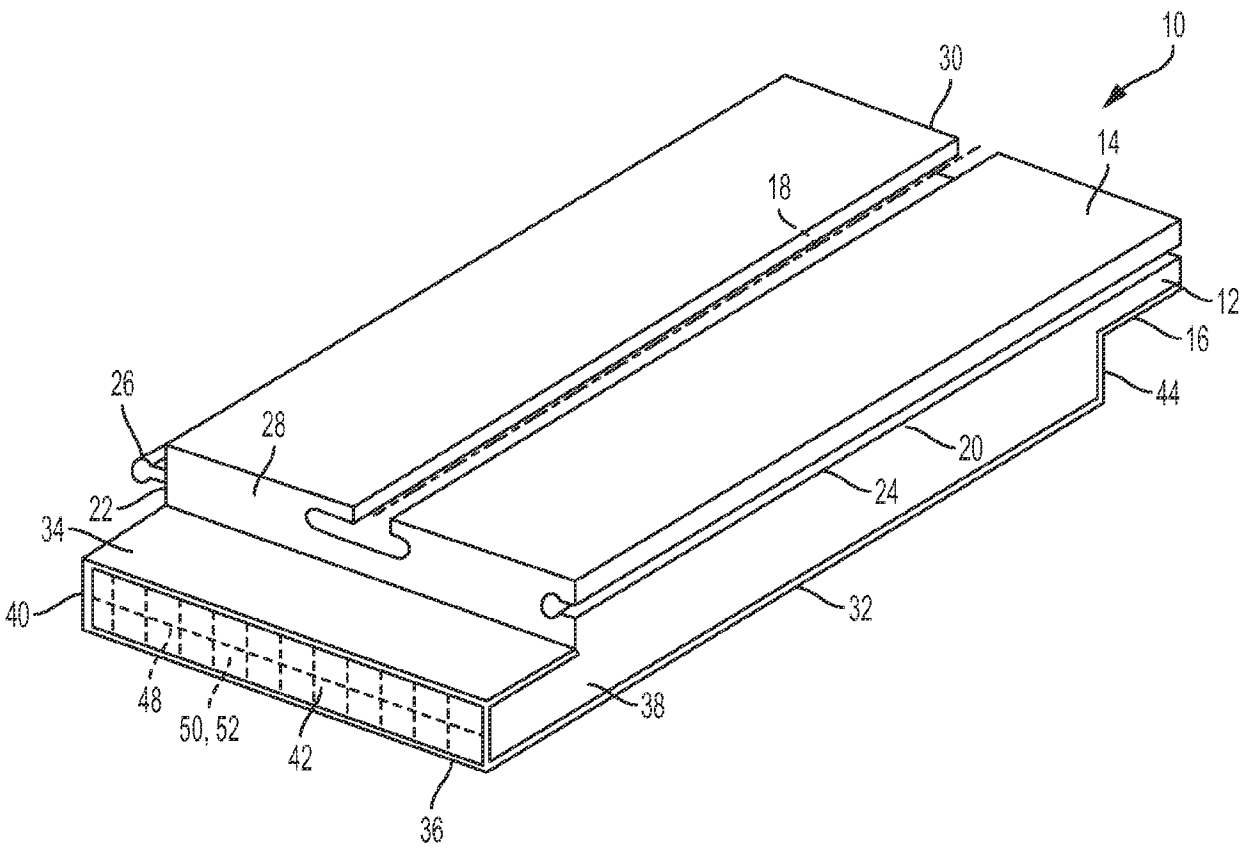
FIG. 2 is an isometric view of another example embodiment of applique armor according to the invention.

FIG. 1 shows an example embodiment of an applique armor unit 10 according to the invention. Armor unit 10 comprises a mounting plate 12 having a first surface 14 and a second surface 16 oppositely disposed. A channel 18 is positioned in mounting plate 12 and extends along the first surface 14. In this example the channel has a "T" shaped cross section, although other cross sectional shapes are of course feasible. Mounting plate 12 further comprises a first edge 20 and a second edge 22 oppositely disposed. Edges 20 and 22 extend substantially parallel to the channel 18. A mortise 24 is positioned within the mounting plate 12 and extends along the first edge 20, and a tenon 26 extends along the second edge 22 and projects outwardly therefrom. In the example embodiment shown in FIG. 1 the mortise and tenon have "T" shaped cross sections. Other cross sectional shapes, such as the bulbous head cross section shown in FIG. 2, are also feasible. Mounting plate 12 also has a first end 28 and a second end 30 oppositely disposed.

Figure 3:
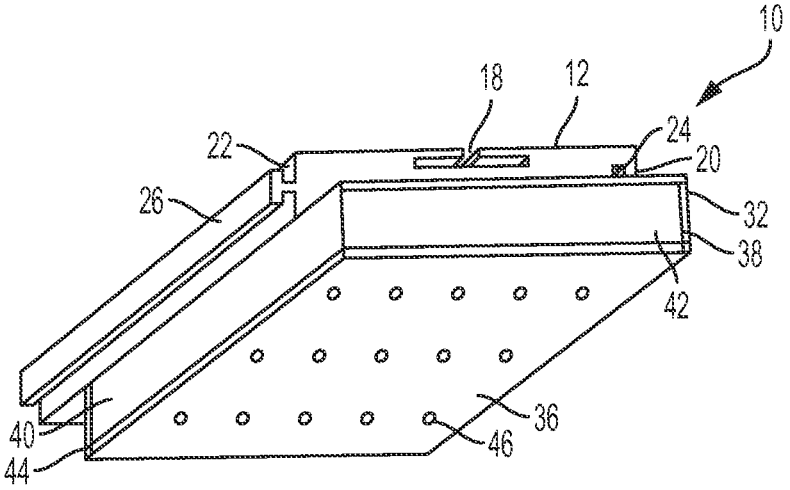
FIG. 3 is an isometric view of another example embodiment of applique armor according to the invention.

A box 32 is attached to the second surface 16 of mounting plate 12. In this example box 32 comprises a top panel 34, a bottom panel 36 (see FIG. 3) positioned in spaced relation to the top panel 34 and to the second surface 16 of the mounting plate 12. Top panel 34 and bottom panel 36 are attached to oppositely disposed first and second side panels 38 and 40 and oppositely disposed first and second end panels 42 and 44. It is advantageous to make the end panels 42 and 44 thinner than the side panels 38 and 40 as explained below. As shown in FIG. 3, the bottom panel 36 may have a plurality of vent holes 46. An open cell layer 48 is positioned within box 32. The open cell layer may take a hexagonal honeycomb form as shown in FIG. 1, or may be an "egg crate" construction as shown in FIG. 2. Open cell layer 48 may be oriented with the open ends 50 of the cells 52 facing top and bottom panels 34 and 36 as shown in FIG. 1, or facing first and second ends 42 and 44 as shown in FIG. 2.

Box 32 has first and second ends 54 and 56 which are offset from the first and second ends 28 and 30 of the mounting plate 12. In the examples shown in FIGS. 1-3 the offset is manifest by the first end 54 of box 32 projecting outwardly from the first end 28 of mounting plate 12, and the second end 30 of the mounting plate 12 projecting from the second end 56 of the box 32. This offset configuration permits overlapping engagement between applique armor units when arranged one behind another as described below.

Figure 4:
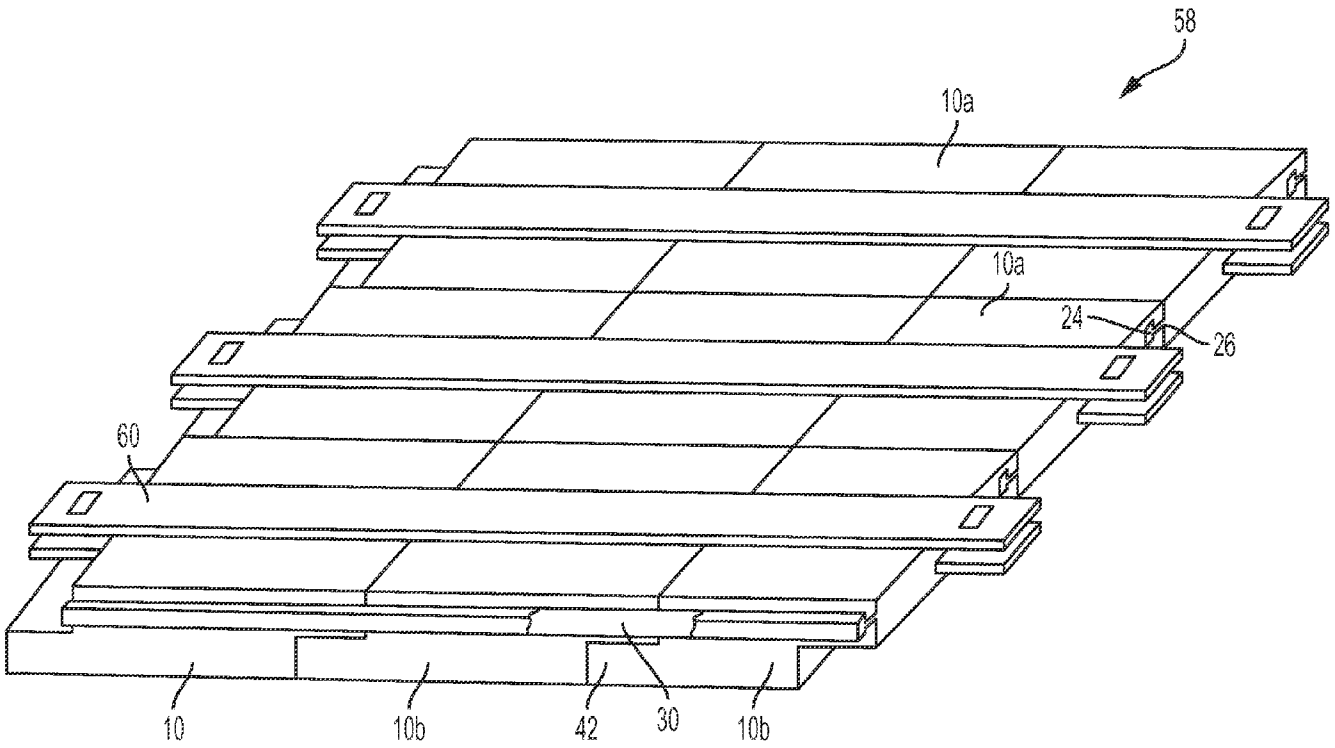
FIG. 4 is an isometric view of an example combination applique armor and mounting according to the invention.

FIG. 4 shows a combination applique armor units 10 and mounting system 58. Combination 58 comprises one or more applique armor units 10 (mounting plate 12 and box 32) and one or more beams 60. In this example beams 60 are "I" beams each having a web 62 and flanges 64 attached to the web (see FIG. 5). One or more beams 60 are attached to the structure to be protected by the applique armor, for example, the chassis of a vehicle, and the applique armor units 10 are mounted on the beams, the flange and at least a portion of the web being received within the channels 18 of the mounting plates 12. Use of the flanged I beam 60 with a channel 18 having a compatible cross sectional shape permits easy mounting and dismounting of the applique armor units 10 while also reliably retaining the applique armor units to the protected structure (not shown). When used in combination, the applique armor units 10 cooperate in interlocking fashion such that for mounting plates 12 on applique units 10*a* positioned adjacent to one another, the tenon 26 on one mounting plate engages the mortise 24 on the adjacent mounting plate. Furthermore, for mounting plates 12 on applique units 10*b* positioned one behind another, the second end 30 of one mounting plate 12 overlaps the first end 42 of box 32 of the applique armor unit behind. This interlocking engagement adds structural integrity and eliminates gaps between the applique armor units 10, and is expected to provide improved armor protection against blast shock, heat, gas and shrapnel. As shown in FIG. 2, additional protection against blast is expected to be afforded by orienting open cell layer 48 with the open ends 50 of the cells 52 facing the first and second end panels 42 and 44 and having the end panels thinner than the side panels 38 and 40. Being thinner, these end panels are expected to blow out when the box 32 is subject to blast, and thereby direct a majority of the blast toward the ends of the applique armor units 10. By arranging the beams 60 lengthwise along a vehicle for example, the blast effects are expected to be directed toward the front and the rear, and not in a normal upward thrust thus preventing harm to the occupants in the personnel compartment above. Gaseous blast and heat energy and fragments are thus directed substantially horizontally away from the vehicle towards its front and rear, and the mounting plates 12 along with bottom and top panels 36 and 34 prevent fragments from entering the vehicle.

Figure 5:
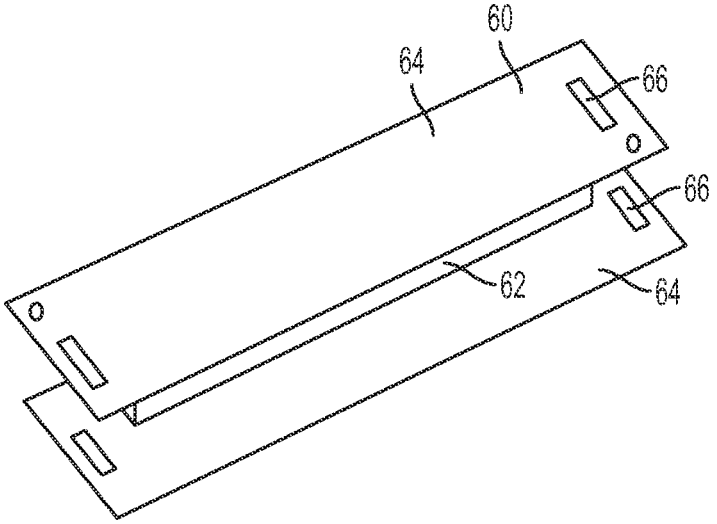
FIGS. 5-7 are isometric views of example mounting components used with the applique armor according to the invention.
Figure 6:
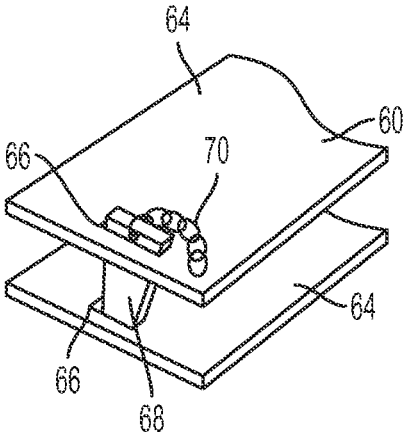
Figure 7:
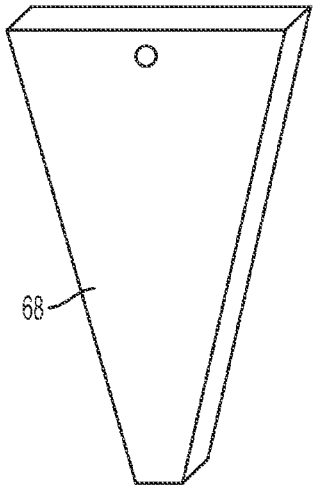

As shown in FIGS. 5 and 6, the beams 60 have slots 66 positioned in the flanges 64 proximate the ends of the beam. Wedge retaining plates 68, shown in FIG. 7, are positioned within the slots 66 to retain the applique armor units 10 to the beams 60. The wedges are readily removable to facilitate removal and replacement of units 10. Each wedge 68 may be attached to a beam 60 via a chain 70 for retaining the wedges when they are not engaged within the slots.

Figure 8:
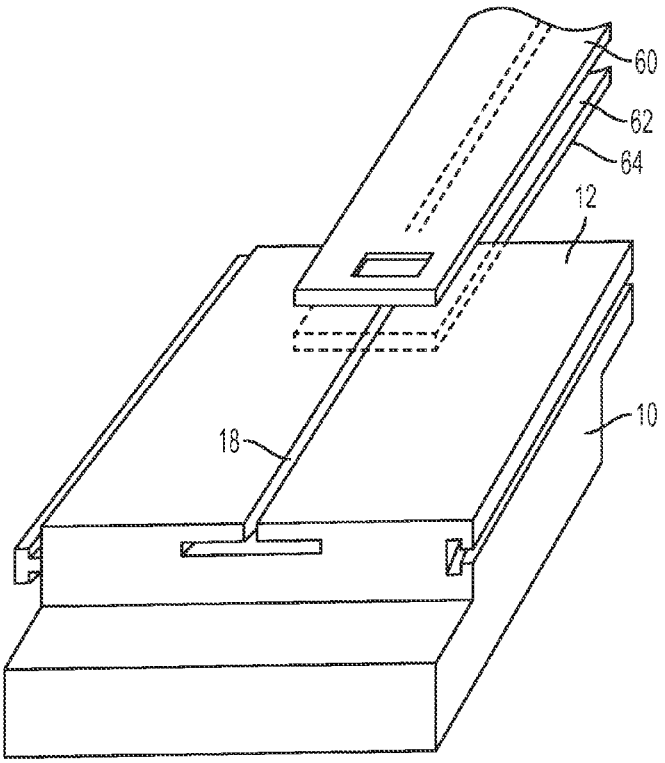
FIG. 8 is an isometric view illustrating an example method of mounting applique armor according to the invention.

Applique armor units 10 may be easily and quickly mounted on a structure, such as a vehicle. One or more beams 60 are attached to the bottom of the chassis, for example by welding, and, as shown in FIG. 8, the applique armor units 10 are slid onto the beam by engaging the flange 64 and web 62 with the channel 18 in the mounting plates 12. To reduce sliding friction between the I beams and the mounting plates it is advantageous to position a lubricant, such as a layer of polytetrafluoroethylene (Teflon), grease, or silicone on the surface of the lower flange 64 that interfaces with the channel 18. Other lubricants are also feasible. The number of beams 60 and number of applique armor units 10 can be tailored to the size of the vehicle to provide thorough protection. As the applique armor units 10 are slid onto the beams 60, the tenons 26 engage mortises 24 on adjacent units and the mounting plates 12 and boxes 32 overlap for units positioned one behind another as shown in FIG. 4. The applique armor units 10 may be supported on a wheeled hydraulic jack or scissor jack when engaging the beams. Use of a wheeled support jack permits faster manual mounting and dismounting of armor units 10. Furthermore, no tools are needed to assemble the applique armor according to the invention, and thus up-armoring a vehicle can be accomplished under rough conditions as encountered in the field.

In a practical example, applique armor units 10 can be built to standard dimensions, with 2 feet by 4 feet by about 4-6 inches in depth being thought advantageous, although 2 feet by 3 feet, 2 feet by 2 feet, and 2 feet by 1 foot are also feasible, thereby permitting a combination of unit sizes to amply protect any unprotected areas of the vehicle. Candidate materials for the mounting plate 12, the box 32 and the open cell layer include metals, in particular titanium in view of its high strength and relatively low density.

It is expected that advantageous protection for a minimum weight penalty can be achieved if titanium alloy meeting military specification Ti MIL-BTL 46077G or similar protective material is used for the applique armor units 10. In a practical example of an all titanium design, the mounting plate 12 is 2.1 inches thick, the top panel 34 is 0.406 inches thick, the bottom panel 36 is 0.25 inches thick, the open cells 48 are 2.0 inches deep and 0.125 inches thick, side panels 38 and 40 are 0.25 inches thick and blow-out end panels 42 and 44 are 0.0156 inches thick. Further in the way of a practical design, the channel 18 is dimensioned to receive a wide flange I beam 60, in a particular example, an ASTM standard W4X13 I beam wherein the flanges 64 have a width of about 4 inches.

Figure 9:
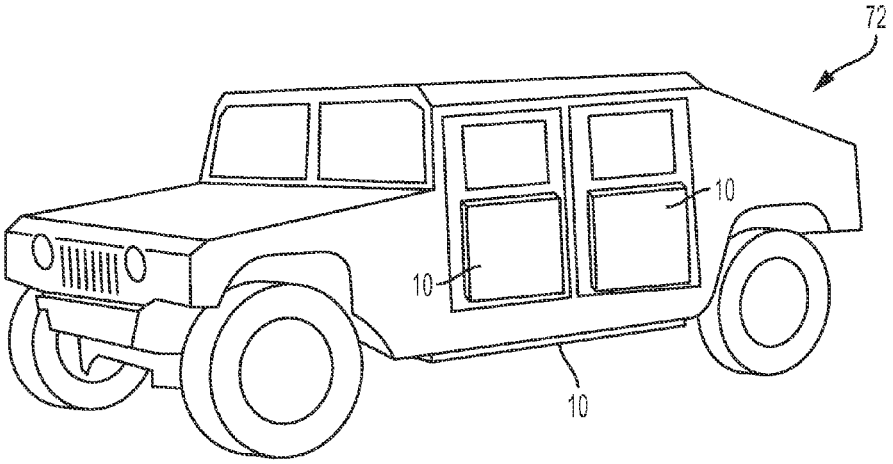
FIGS. 9-11 illustrate potential example uses of applique armor according to the invention.
Figure 10:
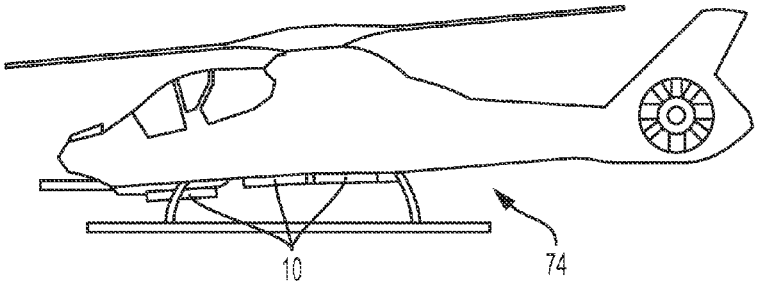
Figure 11:
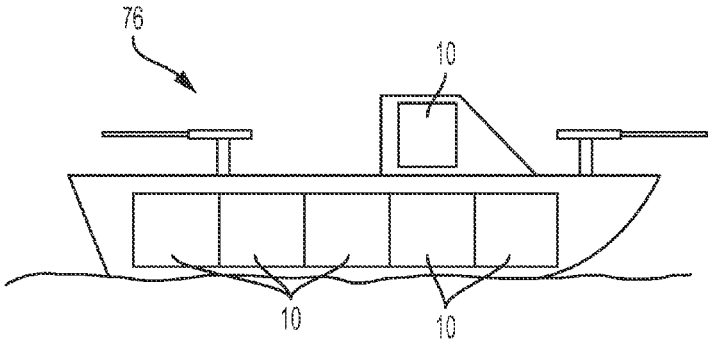

FIGS. 9-11 illustrate a few potential uses of the applique armor according to the invention. FIG. 9 shows a thin skinned military vehicle 72 "up-armored" through the use of applique armor 10 used on the sides and bottom of the vehicle where mine damage and small arms fire can be expected. Similarly, as shown in FIG. 10, areas on aircraft 74 vulnerable to ground fire, such as the underbelly, may be covered with applique armor 10 for increased protection. As shown in FIG. 11, naval vessels 76, especially those designed for riverine and littoral combat, where small arms fire is encountered, can benefit from the increased protection afforded to hull and superstructure by applique armor 10.

The applique armor according to the invention is expected to secure numerous advantages over rolled homogeneous armor plate made of steel. For example, attachment of the applique armor units 10 to a vehicle is greatly simplified as compared with armor plate and can be done under primitive conditions in the field. Mounting and dismounting of the applique armor on the I beams takes little time, allowing for rapid replacement of damaged boxes. Furthermore, undamaged boxes can readily be salvaged from otherwise damaged vehicles and used on other vehicles. Due to their regular and uniform shape, the units 10 can be stacked and transported conveniently. The relatively modest depth of the units (4-6 inches) ensures that they will not significantly affect the ground clearance of most vehicles. When used on the underside of a vehicle, the applique armor lowers its center of gravity, thus increasing vehicle stability.

The applique armor according to the invention is also expected to provide the same or better protection than armor plate at a lower weight penalty. Theoretical calculations comparing applique armor according to the invention with 2 inch rolled homogeneous armor plate currently used on Stryker armored personnel carriers indicate that, while both are capable of absorbing a blast producing an overpressure of about 61,460 psi, the applique armor according to the invention and having the thickness dimensions as described above weighs approximately 28% less than the rolled homogeneous armor plate of steel, thereby producing a significant weight savings. The calculations include the weight of the I beam mounting structure.

What is claimed is:

1. In combination, applique armor and a mounting system for mounting said applique armor to a structure, said combination comprising:

a plurality of mounting plates, each said mounting plate comprising:

first and second surfaces oppositely disposed;

a channel extending along said first surface, each said channel having a T shaped cross section;

a box attached to said second surface of each said mounting plate, said combination further comprising:

a plurality of beams received within said channels, said beams being attachable to said structure, each said beam comprising a web and a flange attached to said web, said webs and flanges sized to be received within said channels, said mounting plates being arranged on said beams one behind another and one adjacent another.

2. The combination according to claim 1, further comprising an open cell layer positioned within each said box.

3. The combination according to claim 1, wherein each said mounting plate further comprises:

first and second edges oppositely disposed and extending substantially parallel to said channel;

a mortise positioned in said mounting plate and extending along said first edge;

a tenon extending along said second edge and projecting outwardly therefrom, wherein for said mounting plates positioned adjacent to one another, said tenon on one of said mounting plates engages a mortise on another of said mounting plates.

4. The combination according to claim 1, wherein:

each of said mounting plates has a first end and a second end oppositely disposed;

each of said boxes has a first end and a second end oppositely disposed; wherein said first ends of each of said boxes project outwardly from said first ends of each of said mounting plates;

said second ends of each of said mounting plates project outwardly from each of said second ends of each of said boxes; and for said mounting plates positioned one behind another, said second ends of said mounting plates overlap said first ends of said boxes.

5. The combination according to claim 1, further comprising:

first and second slots positioned proximate to opposite ends of each of said beams;

first and second wedges removably positioned within said slots for retaining said mounting plates on said beam.

* * * * *